US008549771B2

(12) United States Patent
Hopkins

(10) Patent No.: US 8,549,771 B2
(45) Date of Patent: Oct. 8, 2013

(54) DRYNESS DETECTION METHOD FOR CLOTHES DRYER BASED ON PULSE WIDTH

(75) Inventor: Thomas L. Hopkins, Mundelein, IL (US)

(73) Assignee: STMicroelectronics, Inc., Coppell, TX (US)

( * ) Notice: Subject to any disclaimer, the term of this patent is extended or adjusted under 35 U.S.C. 154(b) by 917 days.

(21) Appl. No.: 12/603,241

(22) Filed: Oct. 21, 2009

(65) Prior Publication Data

US 2011/0088278 A1 Apr. 21, 2011

(51) Int. Cl.
*F26B 13/10* (2006.01)

(52) U.S. Cl.
USPC ..... 34/528; 34/531; 34/548; 34/550; 34/572; 68/12.16; 68/23 R; 8/159

(58) Field of Classification Search
USPC ..... 34/433, 413, 497, 90, 80, 524, 527, 34/528, 531, 548, 550, 572; 68/12.12, 68/12.16, 5 C, 23 R, 20; 8/137, 159
See application file for complete search history.

(56) References Cited

U.S. PATENT DOCUMENTS

| | | | | | |
|---|---|---|---|---|---|
| 3,394,467 | A * | 7/1968 | Janke | 34/532 |
| 3,721,908 | A * | 3/1973 | Jurjans | 327/392 |
| 4,209,915 | A * | 7/1980 | Keuleman et al. | 34/549 |
| 4,547,977 | A * | 10/1985 | Tenedini et al. | 34/538 |
| 5,187,879 | A * | 2/1993 | Holst | 34/261 |
| 5,315,765 | A * | 5/1994 | Holst et al. | 34/260 |
| 5,321,897 | A * | 6/1994 | Holst et al. | 34/260 |
| 5,818,241 | A * | 10/1998 | Kelly | 324/640 |
| 5,940,985 | A * | 8/1999 | Kamikawa et al. | 34/471 |
| 7,043,855 | B2 * | 5/2006 | Heilman et al. | 34/389 |
| 7,146,749 | B2 * | 12/2006 | Barron et al. | 34/596 |
| 7,415,781 | B2 * | 8/2008 | Barron et al. | 34/595 |
| 7,503,127 | B2 * | 3/2009 | DuVal et al. | 34/381 |
| 7,812,504 | B1 * | 10/2010 | Trandafir | 310/317 |
| 8,245,415 | B2 * | 8/2012 | Bellinger | 34/389 |
| 2003/0188740 | A1 * | 10/2003 | Tribelsky et al. | 128/200.14 |
| 2007/0022623 | A1 * | 2/2007 | Yongfeng | 34/245 |
| 2007/0094888 | A1 * | 5/2007 | Barron et al. | 34/597 |
| 2011/0088278 | A1 * | 4/2011 | Hopkins | 34/443 |
| 2011/0088279 | A1 * | 4/2011 | Hopkins | 34/443 |
| 2011/0153086 | A1 * | 6/2011 | Bellinger | 700/275 |
| 2011/0305897 | A1 * | 12/2011 | Hasch et al. | 428/326 |
| 2012/0285035 | A1 * | 11/2012 | Bellinger | 34/380 |

FOREIGN PATENT DOCUMENTS

| | | | |
|---|---|---|---|
| EP | 413517 | A2 * | 2/1991 |
| EP | 604260 | A1 * | 6/1994 |
| EP | 779639 | A1 * | 6/1997 |
| GB | 2273973 | A * | 7/1994 |
| JP | 54085470 | A * | 7/1979 |

(Continued)

*Primary Examiner* — Steve M Gravini
(74) *Attorney, Agent, or Firm* — Seed IP Law Group PLLC

(57) ABSTRACT

A device and method are provided for detecting a root moisture content of clothing in a clothes dryer. The dryer has two conducting bars situated in the dryer bin. A pulse generator circuit is coupled to the conducting bars. A microcontroller is coupled to an output of the pulse generator circuit. The pulse generator circuit generates a pulse when wet clothing contacts the conducting bars in the dryer bin. The microcontroller receives the pulses and counts the pulses that are longer than a threshold length. The microcontroller issues a termination signal based on the number of counted pulses.

6 Claims, 6 Drawing Sheets

(56) References Cited

FOREIGN PATENT DOCUMENTS

| | | | | |
|---|---|---|---|---|
| JP | 55102852 | A | * | 8/1980 |
| JP | 57199731 | A | * | 12/1982 |
| JP | 01193515 | A | * | 8/1989 |
| JP | 01317498 | A | * | 12/1989 |
| JP | 02126804 | A | * | 5/1990 |
| JP | 2012079607 | A | * | 4/2012 |
| WO | WO 991389 | A1 | * | 1/1999 |

* cited by examiner

DRYNESS DETECTION METHOD FOR CLOTHES DRYER BASED ON PULSE WIDTH

TECHNICAL FIELD

The present disclosure relates to a method and a circuit for detecting the moisture content of articles in an automatic dryer.

DESCRIPTION OF THE RELATED ART

Many clothes dryers allow the user to select a specific amount of time for the clothes dryer to dry a load of laundry. This selection can be made using a dial or a digital interface on the outside of the dryer.

Many dryers alternatively allow the user to select a level of dryness to which the dryer will dry a load of laundry. In this type of dryer there is typically some kind of mechanism for monitoring how dry the laundry is. When the dryer detects that the load of laundry has reached the level of dryness selected by the user, then the drying cycle ends.

In one system the humidity of the air exiting the dryer is monitored. As the dryer dries the clothes, water in the clothes evaporates and is expelled through the dryer vent. At first the air in the dryer is quite humid. But as the clothes become drier, the humidity in the air passing through the vent decreases. In such a system the dryer assumes that the clothes are dry once the humidity of the air passing through the vent has dropped below a threshold value. The dryer then turns off.

A challenge faced by automatic dryers is to ensure that the clothes do not stay in the dryer too long. This is countered by the need to ensure that the clothes are sufficiently dry. Over-drying clothes can damage certain types of delicate clothing and waste electricity. A dryer that frequently continues to operate after the clothes are dry may also shorten its own lifetime.

BRIEF SUMMARY

In one embodiment, two conductors are positioned in the drying bin of a clothes dryer. A pulse generator circuit is coupled to the two conductors to transmit an electric current through the clothes as they dry. An output of the pulse generator circuit is coupled to a microcontroller for determining the dryness of the clothes.

As wet clothing tumbles in the dryer during a drying cycle, the wet clothing periodically comes into contact with the two conductors. When the clothing is in contact with the two conductors, the clothing acts as a conductor having a resistance value that varies with the moisture content of the clothes. It is thus seen by the circuit as a resistor connected between the two conductors. When the resistance between the two conductors is low enough, the pulse generator circuit will charge a capacitor to a threshold value. When the capacitor is charged to a threshold voltage, a transistor is turned on which generates a pulse. The pulses typically indicate that a resistance between the first and second conductors is below a threshold value. The pulses are output to the microcontroller.

In one embodiment the microcontroller compares each pulse to a threshold length of time. If the pulse is longer than the threshold length of time, then the microcontroller counts the pulse. If the pulse is shorter than the threshold length of time, then the microcontroller does not count the pulse. The microcontroller issues a termination signal to end the drying cycle if a rate of counted pulses drops below a threshold rate.

One embodiment is a method for detecting the dryness of clothes. The method comprises drying clothes in a clothes dryer and sensing a resistance between two conductors in a dryer bin; generating a pulse when the resistance between the pulses is lower than a threshold resistance; outputting the pulses to a microcontroller; comparing the length of the pulses to a threshold length; counting the number of pulses longer than the threshold length; and issuing a termination signal when the rate of occurrence of counted pulses drops below a threshold rate.

DETAILED DESCRIPTION

Figure 1:
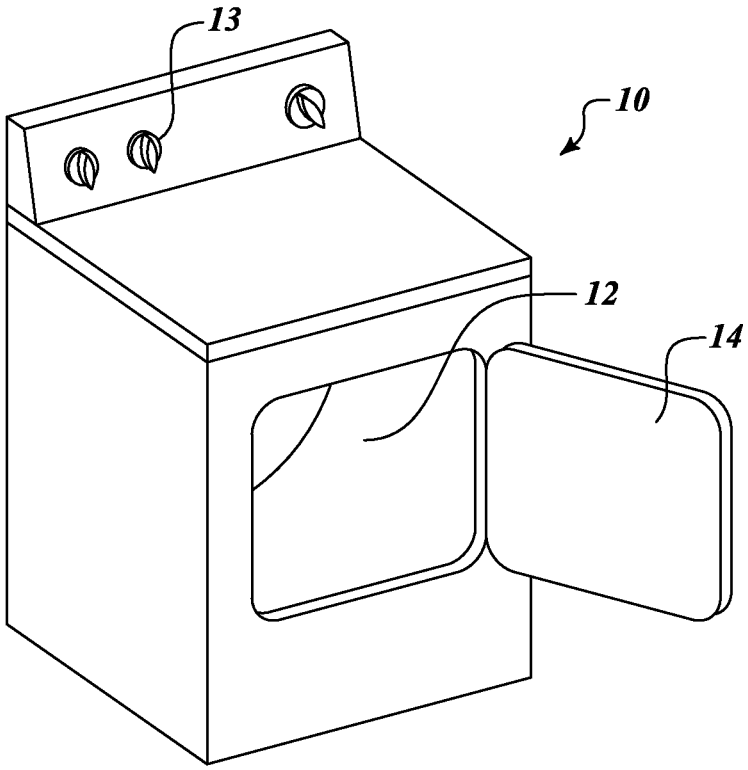
FIG. 1 is a side elevational view of a dryer with the door open exposing the dryer bin.

FIG. 1 illustrates a dryer 10. The dryer 10 has a dryer bin 12 in which a user places wet clothing or other articles to be dried. The dryer 10 has a door 14 which opens to enable access to the dryer bin 12. The dryer 10 has a panel which has a user input 13.

The user can use the user input 13 to select an automatic drying cycle and a desired level of dryness for the automatic drying cycle. The dryer 10 is configured to end the automatic drying cycle when clothes placed in the bin 12 have reached the level of dryness specified by the user.

Figure 2:
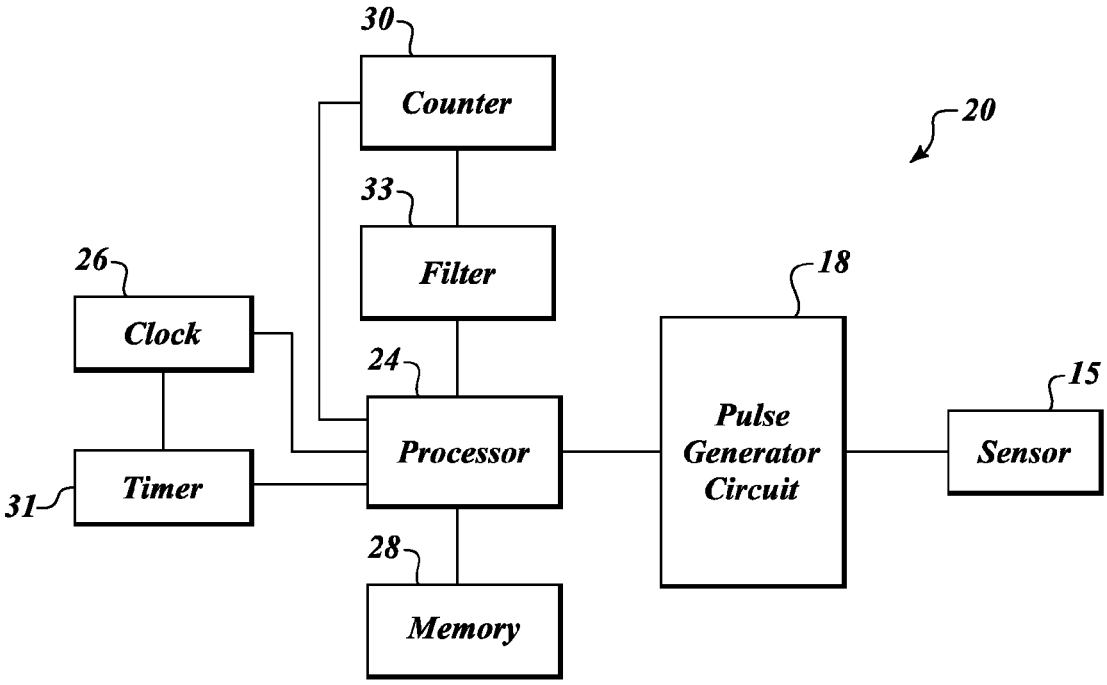
FIG. 2 is a block diagram of a moisture detection circuit according to one embodiment.

FIG. 2 illustrates a dryness moisture detection circuit 20 according to one embodiment of the invention. A sensor 15 is located in the dryer bin 12. The sensor 15 is configured to detect a moisture content of clothing or other articles in the dryer bin 12 or to enable detection of a moisture content of the clothing or other articles in the dryer bin.

The sensor 15 is coupled to a pulse generator circuit 18. When wet clothes contact the sensor 15, the pulse generator circuit 18 outputs a pulse to a processor 24. The processor 24 is coupled to a clock 26, a memory 28, a counter 30, a timer 31, and a filter 33. The memory 28 stores and retrieves data. The data includes information regarding pulses received from the pulse generator, software to enable execution of programs by the processor 24, or any other data which may be used by the processor 24 or other components The counter 30 counts a number of pulses received by the processor 24 from the pulse generator circuit 18. The timer 31 may be used to measure a time duration of pulses sent from the pulse generator circuit 18. The filter 33 filters pulses which are shorter than a threshold length. In one embodiment pulses that are shorter than a threshold length will not be counted by the counter 30.

In one embodiment, the processor 24 monitors the counter 30 to determine if the number of counted pulses in a selected time period is smaller than a threshold number. If the number of counted pulses is smaller than a threshold number then the processor 24 issues a termination signal to end the drying cycle.

Other embodiments may have fewer or more components than those shown in FIG. 2. Also, the components may be connected differently to each other without departing from the scope of the present disclosure.

Figure 3:
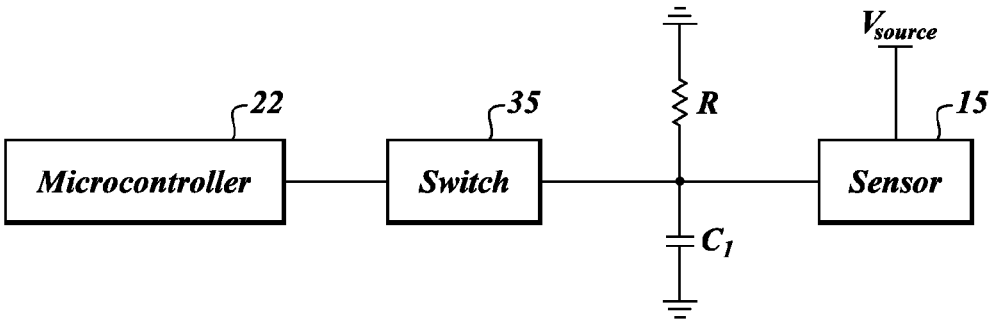
FIG. 3 is a block diagram of a moisture detection circuit according to one embodiment.

FIG. 3 illustrates an alternative embodiment of the invention. The sensor 15 is coupled to a voltage source Vsource. The output of the sensor is coupled to sense node Ns, a capacitor $C_1$, a resistor R, and a switch 35. When articles or clothing in the dryer bin 12 contact the sensor 15 the capacitor $C_1$ begins to charge. The capacitor $C_1$ will charge towards a voltage dependent on a moisture content of the clothing. If the moisture content is high enough, then the capacitor $C_1$ will charge quickly beyond a threshold voltage of the switch 35 and activate the switch 35. The switch 35 causes a pulse to be output to a microcontroller 22 when the voltage on the capacitor $C_1$ charges beyond the threshold voltage of the switch 35. The value of the resistor R is selected to permit the capacitor to charge to the threshold value when wet clothes are present under normal operating conditions. The value of R is usually a high resistance, such as in the mega ohm range; after the clothes are no longer in contact with the sensor, the capacitor will discharge through R to be ready for the next sensing event.

If the resistance of the clothes is low, as will be the case for moist clothes, then current through the resistor R will be low compared to the charging current through the dry clothes, which will permit the capacitor to charge to the threshold voltage. If the resistance of the clothes is high, when the clothes are dry enough, then the voltage dropped across the clothes will prevent the capacitor from charging to the threshold voltage and the switch will not be activated. In other words, if the resistance of the clothes is high the current flow to charge the capacitor will be low. Further, the current will bleed off via resistor R at a rate that prevents the capacitor from charging to the threshold voltage. If the current through resistor R is higher than the current through the clothes, the capacitor $C_1$ will never charge.

In one embodiment the microcontroller 22 may include the processor 24, the clock 26, the memory 28, the counter 30, the timer 31, and the filter 33. The microcontroller 22 receives pulses from the switch 35. Counter 30 counts the pulses. The filter 33 filters pulses that are shorter than a threshold length of time and cause the counter to count only those pulses which are longer than the threshold length of time. Counter 30 counts the pulses. The processor 24 monitors the counter 30 to determine if the number of counted pulses in a selected time period is smaller than a threshold number. If the number of counted pulses is less than a threshold number, then the processor 24 issues a termination signal to end the drying cycle.

Figure 4:
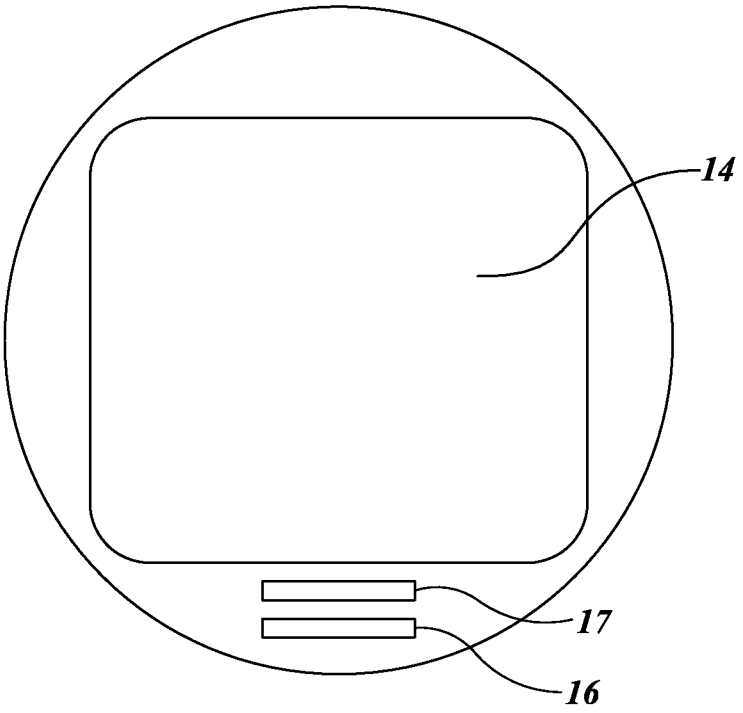
FIG. 4 is a view from the inside of the dryer bin showing two conducting bars situated in the dryer bin below the door of the dryer according to one embodiment.

FIG. 4 illustrates a view of the inside of the dryer bin 12, looking at the door 14, from the inside of the dryer bin 12. In one embodiment, the sensor 15 is two conducting bars 16 and 17 positioned below the door 14. In one embodiment, the conducting bars 16 and 17 are between eight and ten inches in length, and are spaced apart by about an inch. In other embodiments, the bars 16 and 17 are 2-3 inches long and spaced apart by ⅛ of an inch. The conducting bars 16 and 17 are electrically insulated from each other when the dryer bin 12 is empty. The conductors 16 and 17 may of course be other shapes than bars and may be other sizes and spaced differently than described above.

Prior to the beginning of a drying cycle, wet clothes or other articles are loaded into the bin 12 of the dryer 10. The user then selects an automatic drying cycle at the user input 13 and begins the drying cycle. During the drying cycle the dryer 10 tumbles the clothes. The clothes are thus moved about throughout the bin 12. As the clothes tumble, individual items of clothing randomly and momentarily come into contact with both conducting bars 16 and 17 below the door 14. If an item of clothing contacts both conducting bars 16 and 17 simultaneously, then the clothing momentarily acts as a conductor having a resistance value connected between the two conducting bars 16 and 17. Of course, two items of clothing that are in contact with each other, while each is in contact with respective conductive bars, will also act as a resistive electrical conductor between the conducting bars 16 and 17.

Wet clothing generally has a lower resistance than dry clothing. When wet clothing contacts the conductive bars 16 and 17 there is a lower resistance between the conducting bars 16 and 17 than if dry clothing contacts the conductive bars 16 and 17. This configuration can be utilized to sense a relative moisture content (RMC) of the clothing. When the RMC of the clothing drops below a threshold level, according to the automatic drying cycle selected, the dryer 10 automatically shuts off.

Figure 5:
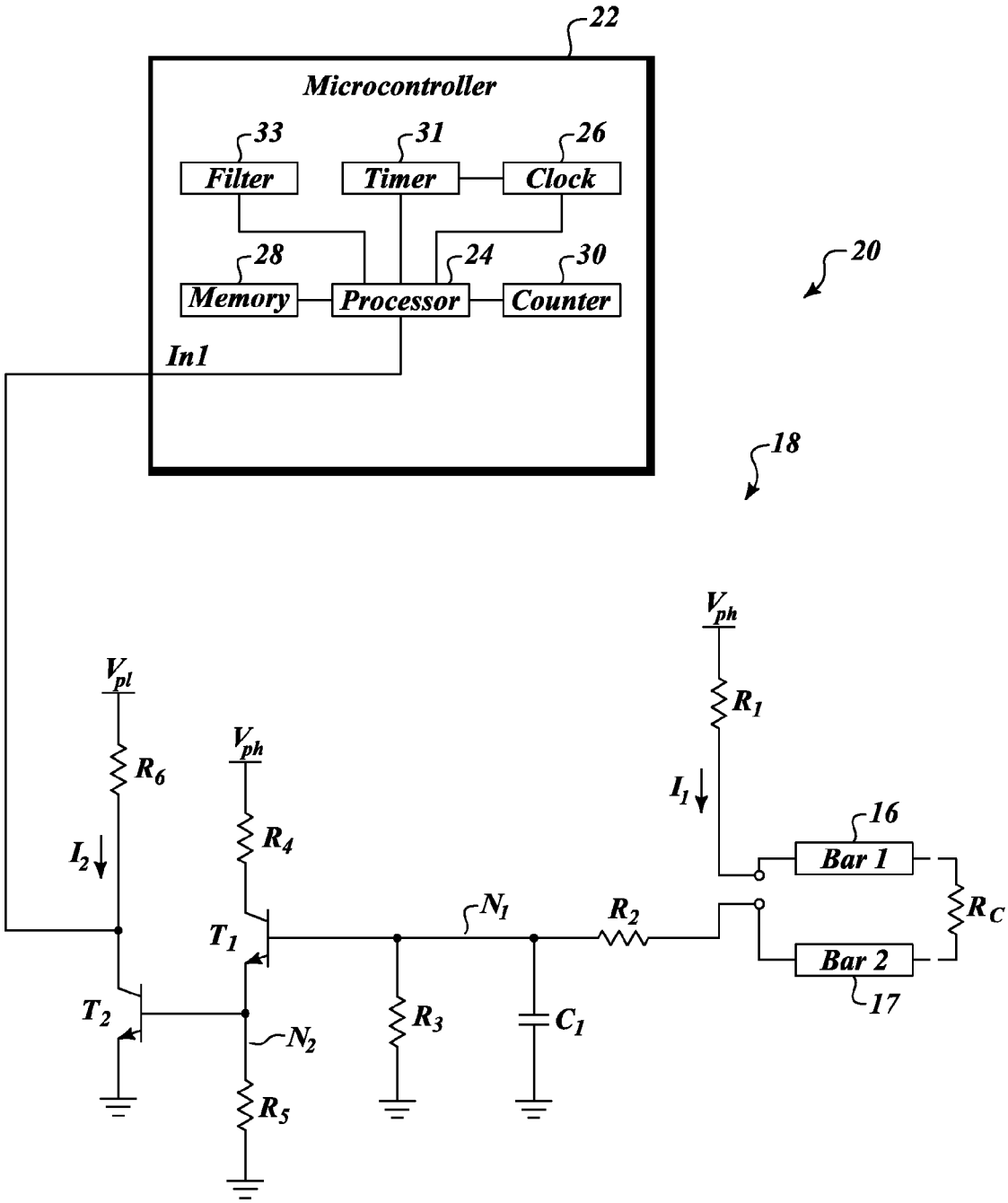
FIG. 5 is a schematic diagram of a moisture detection circuit according to one embodiment.

FIG. 5 illustrates a moisture detection device 20 according to one embodiment of the present invention. A pulse generator circuit 18 is coupled to the conductive bars 16 and 17. The pulse generator circuit 18 typically is not located in the dryer bin, but may be located in any suitable portion of the dryer that protects the circuit from being damaged.

A resistor $R_1$, for example 4 kΩ, is connected between a high positive voltage supply Vph, for example 17V, and the first conductive bar. The second conductive bar is not electrically connected to the first conductive bar in the situation illustrated in FIG. 4. When clothes touch both bar 16 and bar 17 at the same time, a conductor having the resistance value $R_c$ couples the two bars together. The value of $R_c$ will vary from less than 4 kΩ when the clothes are wet to greater than 5 MΩ when the clothes are dry. The value of $R_c$ is a sufficiently reliable measure of the amount of moisture in the clothing for use in this circuit to determine when to shut off the dryer. A resistor $R_2$, for example 4 kΩ, is coupled between the second conductive bar and node $N_1$. A capacitor $C_1$, for example 3.3 nF, is coupled between node $N_1$ and ground. A resistor $R_3$, for example 5 MΩ, is coupled between $N_1$ and ground. The base of transistor $T_1$ is coupled to $N_1$. Resistor R4, for example 750 kΩ, is coupled between the high positive voltage supply and the collector of $T_1$. The emitter of $T_1$ is coupled to node $N_2$. A resistor $R_5$, for example 68 kΩ, is coupled between $N_2$ and ground. The base of transistor $T_2$ is also coupled to $N_2$. The emitter of $T_2$ is coupled to ground. The collector of $T_2$ is coupled to an input In1 of microcontroller 22. Resistor $R_6$, for example 100 kΩ, is coupled between a low positive voltage supply $V_{p1}$, for example, 5V and In1. The specific values and configuration of circuit components are given merely by way of example and are not limiting. The circuit components may be arranged in many other configurations and have many other values according to other embodiments of the invention. In particular, transistors $T_1$ and $T_2$ may be implemented as MOS transistors or any other suitable transistor according to other embodiments of the pulse generator circuit 18. Transistors T1 ad T2 may also be replaced by a comparator circuit with a threshold set by a resistor divider network, or other acceptable detection circuit, or some other acceptable transition circuit.

Operation of the circuit of FIG. 5 will now be described. When clothes placed in the bin 12 undergo a drying cycle, they periodically come into contact with the conductive bars 16 and 17. An item of clothing in contact with both bars 16 and 17 acts as a conductor connected between the bars 16 and 17. This conduction allows an electric current $I_1$ to flow between the two bars 16 and 17 at a value related to the resistance of the clothes, $R_c$. $I_1$ flows from the high positive voltage source Vph through $R_1$, through $R_c$ (the clothes), and $R_2$. $I_1$ causes the capacitor $C_1$ to start to charge. If transistors $T_1$, $T_3$, and $T_4$ are off, then $I_1$ will reach the following steady state current:

$$I_1 = \frac{V_{ph}}{R_1 + R_c + R_2 + R_3}$$

where $R_c$ is the resistance of the clothing between the bars 16 and 17.

The current $I_1$ will charge the capacitor to a voltage $V_c$ dependent on the resistance of the clothes $R_c$ according to the following relationship:

$$V_c = I_1 \cdot R_3 = \frac{V_{ph} \cdot R_3}{R_1 + R_c + R_2 + R_3}.$$

If the voltage $V_c$ at node $N_1$ on the capacitor $C_1$ is greater than the base-emitter turn on voltage Vbe1 of transistor $T_1$, then $T_1$ will turn on. If the voltage $V_c$ on the capacitor $C_1$ is greater than Vbe1 plus the base-emitter turn on voltage Vbe2 of transistor $T_2$, then $T_2$ will turn on as well and the voltage at the base of T1 will be clamped to the sum of Vbe1 plus Vbe2. When $T_2$ is turned on, current $I_2$ flows from the low positive voltage source through resistor $R_6$. This causes the voltage to drop at In1. This drop in voltage acts as a pulse at In1. The microcontroller 22 receives the pulses at In1.

In order for a pulse to be sent to the microcontroller 22, the voltage $V_c$ on the capacitor $C_1$ must be equal to or greater than a double threshold voltage $V_t$:

$$V_t = V_{be1} + V_{be2}.$$

The voltage to which the capacitor $C_1$ will charge depends in part on the resistance $R_c$ of the clothing in contact with the bars 16 and 17. Thus, the resistance $R_c$ of clothing which has contacted the bars 16 and 17 must be below a threshold resistance if the voltage $V_c$ on $N_1$ is to exceed $V_t$.

The duration of a pulse corresponds to the length of time that the wet clothing contacts the bars 16 and 17 and to the wetness of the clothing. Once a pulse has been generated on the output Out, the pulse will continue as long as the wet clothing remains in contact with the bars. When the clothing is no longer in contact with the bars 16 and 17, the capacitor $C_1$ discharges through the resistor $R_3$ to ground. The discharge of the capacitor $C_1$ causes the voltage $V_c$ of the node $N_1$ to drop. Once the voltage $V_c$ has dropped below the threshold voltage $V_t$, the transistor $T_2$ turns off and current $I_2$ no longer flows. The voltage at In1 increases to the level of the power supply $V_{p1}$. The return of the voltage at In1 to $V_{p1}$, is the trailing edge of the pulse, which is the end of the pulse.

The microcontroller 22 comprises a processor 24, a clock 26, a system memory 28, a counter 30, a timer 31, and a filter 33, as shown in FIG. 2. The clock 26 may be a crystal oscillator, a resonant circuit, an $R_c$ circuit, or any other means suitable for generating a clock signal. The system memory 28 is coupled to processor 24 and is configured to store and retrieve data. The memory 28 may store program data for the operation of the microcontroller 22, data regarding pulse counts and pulse lengths, or any other data. The memory 28 may include one or more arrays of ROM, EPROM, EEPROM, Flash memory, SRAM, DRAM, or any other suitable memory. The counter 31 is either a register in the processor 24 or is coupled to the processor 24 and serves to count pulses received from the pulse generator circuit 18 at input In1. In practice, the microcontroller 22 may have many more or different components and the components may be connected differently than is shown in FIG. 5.

When the pulse generator circuit 18 generates a pulse at the input In1, the processor 24 detects the pulse and causes the counter 30 to increment. The counter 30 thus counts the number of pulses generated by the pulse generator circuit 18.

In one embodiment, the processor 24 monitors the number of pulses generated during each of a plurality of defined counting periods. At the end of each counting period, the processor 24 monitors the counter 30 to determine the number of pulses received during the counting period. The number of pulses received during the counting period defines a rate at which pulses are being received. At the end of the counting period, a new counting period begins and the rate of pulses is monitored again for the new counting period. In one embodiment, each counting period is about two seconds.

The rate at which pulses are being received corresponds to the RMC of the clothing in the dryer bin 12. If the clothes are wetter, then the pulses will be generated more frequently. If the rate at which pulses are received drops below a threshold pulse rate for a number of counting periods, then the processor 24 determines that the clothes are dry and issues a shutdown signal which terminates a drying cycle of the clothes dryer 10. In one embodiment, the processor 24 issues the shutdown signal if the rate of pulses drops below the threshold rate for two consecutive counting periods. In other embodiments, the processor 24 may issue the shutdown signal after more or fewer counting periods than two.

Under some circumstances, the rate of pulses may falsely indicate that the clothing is wet when the clothing is in fact dry. These errors may arise due to static discharge of the clothing in the dryer bin 12. As the clothing becomes drier, certain types of fabric tend to frequently build up a static charge. When an item of clothing that has a build up of static charge contacts the second conductive bar, the static charge discharges through the second conductive bar. This static discharge quickly charges the capacitor $C_1$ beyond the threshold $V_t$ and a pulse is generated as previously described. Thus, as the clothes become drier, static electricity may cause many pulses to be sent to the microcontroller 22. If not filtered for length, these pulses would increment the counter 30 and the microcontroller 22 might interpret the rate of pulses to mean that the clothing is wet. The pulses due to static discharge may cause the dryer 10 to continue drying after the clothes are already dry. The prolonged drying cycle needlessly wastes energy. The clothing may also be damaged if it remains in the dryer 10 longer than necessary.

The pulses generated due to static discharge are generally very short compared to the pulses generated due to contact of wet clothing with the conductive bars 16 and 17. The reason for this is that a static charge discharges very rapidly as a very small current. A static discharge will quickly charge the capacitor $C_1$ and then cease delivering current. When current is no longer supplied, capacitor $C_1$ discharges through the resistor $R_3$. Pulses generated due to static discharge are thus much shorter than those due to wet clothing.

To overcome this problem, the microcontroller 22 is configured to compare each pulse to a threshold pulse length. The microcontroller 22 will count the pulses that are longer than a threshold time and disregard the pulses that are shorter than the threshold time. The threshold time is selected to be longer than a typical pulse due to static discharge and shorter than a typical pulse due to wet clothing.

In one embodiment the microcontroller 22 is configured to trigger an interrupt at the processor 24 when the leading edge of a pulse is received from the pulse generator circuit 18. The interrupt will last a predetermined number of clock cycles that is considered longer than a pulse due to static discharge. If the pulse is still present after the interrupt is over, the processor 24 causes the counter 30 to increment. If the pulse is not present upon return from the interrupt then the processor 24 does not cause the counter 30 to increment. This is one way to carry out the function of filter 33. Thus the microcontroller 22 does not count pulses which are shorter than a threshold time or pulse length. In this way pulses due to static discharge are not counted. Only pulses longer than a threshold time are counted and the rate of pulses during a counting period more accurately reflects the RMC of the clothing. In one embodiment, the interrupt and counting as described above may be implemented by running software installed on the memory 28 of the microcontroller 22.

In one embodiment, the microcontroller 22 is configured to start a timer 31 when the leading edge of a pulse is received. The timer 31 counts either down from or up to the threshold time. If the timer 31 counts to the threshold time before the trailing edge of the pulse is received, then the pulse is counted. If the trailing edge of the pulse is received before the timer 31 counts to the threshold time then the pulse is not counted.

Various embodiments for the function of filter 33 to filter out pulses that are shorter than the threshold time and cause the counter 30 to increment only if the pulse is longer than the threshold time have been described.

Many other embodiments implementing hardware and/or software to filter pulses due to static discharge are possible. In some embodiments a filter to filter pulses due to static discharge may be implemented as hardware or software in the microcontroller 22. In one embodiment, the pulse generator circuit 18 may be configured to not generate a pulse at all due to static discharge. Many other embodiments of the pulse generator circuit 18 and the microcontroller 22 are apparent in light of the present disclosure and fall within the scope thereof. Specific embodiments are illustrated only by way of non-limiting example.

Figures 6A, 6B:
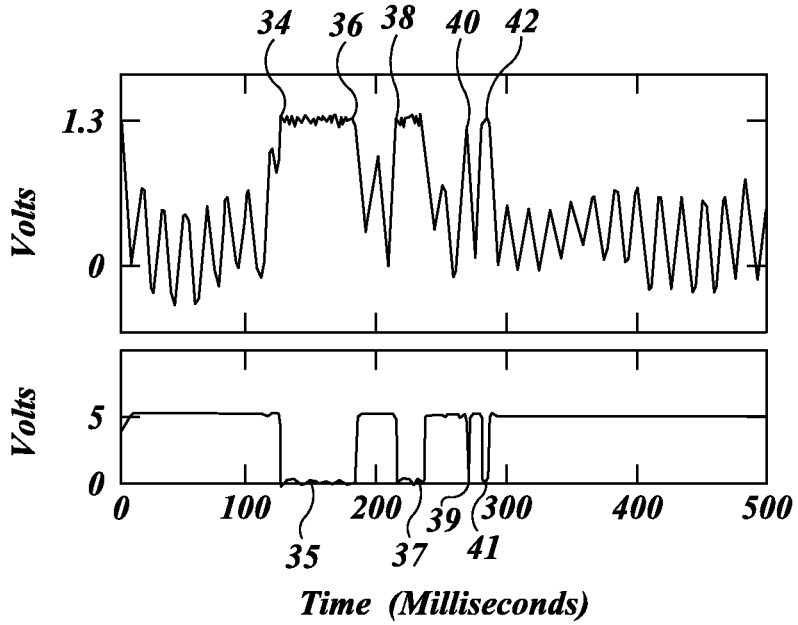
FIG. 6A is a graph illustrating the voltage on a capacitor during a drying cycle of a clothes dryer according to one embodiment.
FIG. 6B is a graph illustrating the voltage of an input to a microcontroller according to one embodiment.

FIGS. 6A and 6B are sample graphs of the voltage on the capacitor $C_1$ and the voltage on the input In1, respectively, during a portion of a drying cycle. FIG. 6A charts the voltage on the capacitor $C_1$ during a 500 millisecond sample of an end portion of a drying cycle. FIG. 6B illustrates the voltage at the microcontroller input In1 for the same time period as shown in FIG. 6A.

In FIG. 6A, the capacitor reaches the threshold voltage of about 1.3V at the point labeled 34. At this time, the voltage at In1 (illustrated in FIG. 6B) drops from 5 volts to about 0 volts. This drop from 5 volts to 0 volts constitutes the leading edge or first edge of pulse 35. In FIG. 6A at 36, the voltage on the capacitor drops below the threshold voltage. At this time the voltage at In1 of FIG. 6B returns to 5V. This constitutes the trailing edge or end of the pulse 35. This pulse 35 lasts about 50 milliseconds.

In FIG. 6B, pulse 37 begins when the voltage on the capacitor in FIG. 6A reaches the threshold voltage at 38. Two very brief pulses, 39 and 41, occur when the voltage on the capacitor briefly reaches the threshold at 40 and 42, respectively. These last two very short pulses 40 and 41 are so short that they are considered to be due to static discharge from the clothing or local noise in the system. A dryer circuit is in an electrically noisy environment and noise may be generated in the sensing circuit from a number of locations, such as from the 60 Hz power line, spiking in the power supplies, the switching control signals, the power for driving the motor that is rotating the drum, the electrical control panel, or even from such sources as the filter mesh, a person banging the lid, or other unexpected locations. The dryness detection circuit 20 as described above is configured to not count pulses generated from sources other than the wetness of the clothing, whether the source is static electricity or some other source of noise. In one embodiment, a threshold time of 10 milliseconds is appropriate to filter out the pulses due to static discharge and noise. In other embodiments, a 20 millisecond threshold time is used to mask noise, while a 5 millisecond time is sufficient to mask noise in some environments. Of course, in some dryers, the numbers might be different and be given in microseconds or seconds based on the dimensions of the bars and how far apart they are from each other.

In the example illustrated in FIGS. 6A and 6B, pulses 39 and 41 are comparatively brief and can be identified as spurious pulses due to static electricity or other noise. The filter 33 of the dryness detection circuit can identify these short pulses and cause them to be filtered so that the counter 30 does not increment. If, for example, the threshold time is 10 ms, then in FIG. 6B, the counter 30 would increment at the trailing edge of pulses 35 and 37 because these pulses are longer than the threshold time. The filter 33 prevents the counter 30 from incrementing for pulses 39 and 41 because the pulses 39 and 41 are shorter than the threshold time. In this way, the dryness detection circuit 20 ignores pulses that are due to static discharge and more accurately determines the dryness of the clothes. Of course, the threshold time may be larger or smaller depending on the dryness detection system and components thereof.

Figure 7:
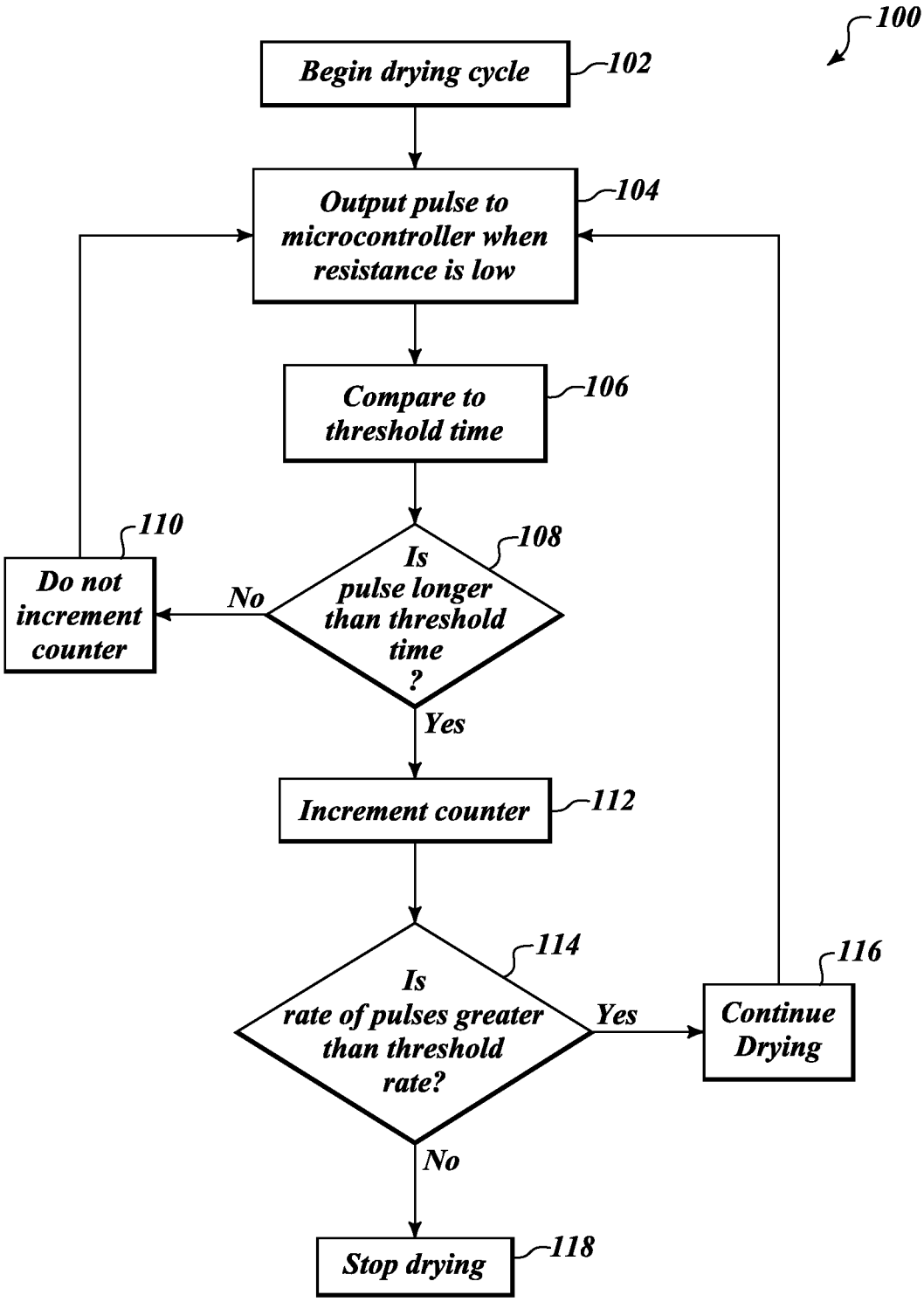
FIG. 7 is a flow chart diagram of a method for determining dryness of clothes according to one embodiment.

FIG. 7 shows a flow diagram 100 which illustrates a method for monitoring and modifying the RMC of clothes in a clothes dryer 10 according to one embodiment. At 102 a drying cycle is begun. This includes putting wet clothing in the dryer bin 12 and selecting a drying cycle at the user input 13 of the dryer 10. Upon beginning the drying cycle, the dryer 10 tumbles the clothes in the bin 12.

At 104 wet clothing comes into contact with conductive bars 16 and 17 located in the dryer bin 12. If the clothing is wet enough, then the resistance between the two bars 16 and 17 will drop below a threshold resistance and a capacitor $C_1$ will charge to a voltage higher than a threshold voltage and turn on transistor $T_2$. When transistor $T_2$ turns on, a pulse is sent to the microcontroller 22.

At 106 the microcontroller 22 compares the pulse duration to a threshold time.

At 108 if the length of the pulse is shorter than the threshold time, then the pulse is disregarded and the counter 30 is not incremented, as shown at 110. If the pulse is longer than the threshold time, then the counter 30 is incremented at 112.

At the end of a counting period at 114, the processor 24 monitors the number of pulses that have been counted. The number of pulses received during the counting period corresponds to a rate of pulses received. If the rate of pulses is lower than a threshold rate, then a termination signal is issued at 118. In one embodiment, the termination signal is issued only if the rate of pulses is lower than the threshold rate in two or more consecutive counting periods.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A clothes dryer, comprising:

a dryer bin;

a first conductor in the dryer bin;

a second conductor in the dryer bin;

a switch coupled to the first conductor and configured to generate a pulse when a resistance between the first and the second conductors is lower than a threshold resistance, a length of the pulse corresponding to a length of time that the resistance is lower than the threshold resistance; and a microcontroller coupled to the switch and configured to receive the pulse and to output a termination signal based on a number of pulses that are longer than a threshold time.

2. The dryer of claim 1 wherein the microcontroller counts pulses during a plurality of counting periods and outputs the termination signal when the number is less than a threshold number in each of two or more consecutive counting periods.

3. The dryer of claim 1, comprising a capacitor coupled to the first and second conductors and to the switch, the capacitor configured to charge according to the resistance between the first and second conductors and to activate the switch when a voltage on the capacitor reaches a threshold voltage.

4. The dryer of claim 1 wherein each pulse triggers an interrupt at a processor of the microcontroller, the microcontroller being configured to count the pulse if the pulse is still present when the processor returns from the interrupt.

5. The dryer of claim 1 wherein the microcontroller is configured to start a timer at a leading edge of the pulse and to compare the length of the pulse to the threshold time as demarked by the timer.

6. The dryer of claim 1 wherein the microcontroller increments a counter if the pulse is longer than the threshold time.

* * * * *